US005238352A

United States Patent [19]

Abe et al.

[11] Patent Number: 5,238,352

[45] Date of Patent: Aug. 24, 1993

[54] WEB ROLL TRANSFERRING APPARATUS

[75] Inventors: Etsuro Abe, Komaki; Hiroki Matsui, Iwakura; Toshihiko Yasui, Owariasahi; Hidetaka Miyazaki, Komaki, all of Japan

[73] Assignee: Kabushiki Kaisha Isowa, Aichi, Japan

[21] Appl. No.: 847,343

[22] Filed: Mar. 6, 1992

[30] Foreign Application Priority Data

Mar. 8, 1991 [JP] Japan ..... 3-12938
Mar. 19, 1991 [JP] Japan ..... 3-16203

[51] Int. Cl.[5] ..... B65G 63/00

[52] U.S. Cl. ..... 414/344; 104/35; 242/79; 414/744.3; 414/744.7; 414/911; 414/908; 414/684; 414/399; 414/222

[58] Field of Search ..... 104/35, 36, 44, 46, 104/48, 49, 50; 242/35 A, 79; 414/344, 371, 222, 576, 744.2, 744.3, 399, 744.7, 911, 908, 684

[56] References Cited

U.S. PATENT DOCUMENTS

| | | | |
|---|---|---|---|
| 823,552 | 6/1906 | Schnell | 104/35 |
| 2,801,812 | 8/1957 | Coulter | 242/79 |
| 3,396,859 | 8/1968 | Vincent | 414/371 X |
| 3,690,583 | 9/1972 | Herman | 242/79 X |
| 4,131,206 | 12/1978 | Kawada et al. | 242/79 X |
| 4,919,353 | 4/1990 | Isowa et al. | 242/79 X |

FOREIGN PATENT DOCUMENTS

| | | | |
|---|---|---|---|
| 2163180 | 7/1973 | Fed. Rep. of Germany | 414/911 |
| 14254 | 4/1990 | Japan . | |

*Primary Examiner*—Frank E. Werner
*Attorney, Agent, or Firm*—Koda and Androlia

[57] ABSTRACT

A web roll transferring apparatus consisting of a roll stand, a couple of bogies which run on the rails disposed on each side of the roll stand and a turntable disposed in a roll transferring station locating in front of the roll stand so as to be rotatable horizontally; transference of a web roll being designed to be carried out between the turntable and the bogies stopping at the predetermined positions provided on each side of the turntable; characterized in that at least one jack disposed beneath the turntable, which can be operated by a fluid pressure and the like so as to tilt the turntable to one of the bogies or to the side opposite to the roll stand to a predetermined angle, and that jacks for tilting the bogies toward the turntable may be disposed at the positions by the turntable where the bogies are to stop.

3 Claims, 13 Drawing Sheets

WEB ROLL TRANSFERRING APPARATUS

BACKGROUND OF THE INVENTION

This invention relates to a web roll transferring apparatus, more particularly to a web roll transferring apparatus, for example, in a roll transferring station of a corrugator for producing a corrugated board sheet continuously, which carries out the operation of carrying web rolls to be used as sheet materials to and from between a bogie and a turntable automatically and speedily.

In a corrugator for producing a corrugated cardboard sheet, large amounts of webs are used as a corrugating medium or liners so as to constitute a sheet. Such webs are supplied in the form of rolls having large diameters from paper making plants to corrugated cardboard manufacturing plants. The web rolls are mounted on a group of roll stands disposed at predetermined positions along the corrugator to deliver webs toward a single facer or a double facer. So as to meet demands for the production of various types of products in small lots, the web rolls under delivery are frequently removed from the roll stands and replaced with other types of web rolls on occasion. Such operations of carrying the web rolls in and out of the roll stands are generally achieved by use of a plurality of bogies which run along the rails extended on each side of the roll stands, respectively. Meanwhile, the operations of carrying in and out the web rolls by the bogies and the replacement of web rolls between a plurality of bogies are in many cases performed at a roll transferring station locating upstream the rolls stands (operational side).

For example, FIG. 12 shows perspectively a roll stand 10 used in a corrugator and a roll transferring station S disposed upstream the roll stand 10 This roll stand 10 is of a swing arm system having supported pivotally thereon a pair of longitudinally opposing first arms 12 and a pair of longitudinally opposing second arms 14, and the core paper tubes of web rolls 19 are designed to be chucked removably by the center blocks 16 disposed to the free end portions of the respective arms to oppose each other. On the floor of the corrugated board manufacturing plant, two pairs of rails 18 are extended parallel to each other on each side of the roll stand 10, on which bogies 20 run to reciprocate freely between the roll stand 10 and the roll transferring station S to be described later. By the swinging motion of the arms 12 (14) in the roll stand 10, mounting of the web roll loaded on the bogie 20 stopping beside the roll stand 10 or demounting of the web roll 19 to an empty bogie 20 is achieved. Incidentally, the bogies 20 each have a gentle V-shaped slope on the top surface. The center line l demarcating the V-shape of the slope is designed to extend parallel with the rails 18.

A disc-shaped turntable 24 is disposed so as to be able to rotate horizontally in the roll transferring station S between these two pairs of rails 18. A gentle V-shaped slope is also formed on the top surface of a turntable 24, so that a web roll 19 can stably be loaded thereon. Incidentally, the horizontal rotation of the turntable 24, either manually or mechanically, for example, by a motor, is indexed by 90° between the position where the center line l thereof is parallel to the rails 18 and the position where the center line l is orthogonal to the rails 18.

The operation of transferring the web roll 19 loaded on the bogie 20 to the turntable 24 is generally carried out in the following manner: The bogie 20 with a web roll 19 loaded thereon runs on the rails 18 and stops at a predetermined position in the station S; wherein the center line l of the turntable 24 is indexed in such a way that it may be parallel with the rails 18 (and the center line l of the bogie 20). In such state, the web roll 19 loaded on the bogie 20 is rolled over manually to the turntable 24. While the thus transferred web roll 19 rolls to and fro for a while on the sloped surface of the turntable 24, the rolling of the roll 19 is gradually damped and finally stops. Next, the turntable 24 with the web roll 19 loaded thereon is rotated horizontally by 90° and stopped at the indexed position to allow the center line l of the turntable 24 to be orthogonal with the rails 18. The roll 19 can be carried out by rolling over the web roll 19 manually in the direction indicated by the outlined arrow in FIG. 12.

On the other hand, the operation of transferring the web roll 19 loaded on the turntable 24 onto the bogie 20 is carried out as follows: After the web roll 19 is loaded on the turntable 24 using, for example, a fork lift truck, the turntable 24 is turned by 90° so as to make the center line l thereof parallel with the rails 18. Subsequently, the web roll 19 loaded on the turntable 24 is pushed manually to roll it over to a bogie 20, and then the bogie 20 with the web roll 19 loaded thereon is allowed to run to the position beside the roll stand 10, followed by chucking of the web roll 19 by the arms 12 (or 14).

Incidentally, the web roll 19 itself has a considerable weight, so that it requires an extremely heavy work of an operator to transfer the web roll 19 manually between the turntable 24 and the bogie 20. Thus, as a countermeasure proposed for solving such problem, some corrugators employ a bogie lifting apparatus as shown in FIG. 13. More specifically, the bogie 20 is of a type which can run freely on the rails via wheels 36 as shown in FIG. 13. A protruding piece 21 is disposed on the outer side portion of the bogie 20, which is pushed up or down by means of a hydraulic or pneumatic jack 40 provided on the ground of the factory site around the station S. By operating the jack 40, the bogie 20 is pivoted counterclockwise on the opposite side wheels 36, whereby a required degree of gradient is secured on the top surface of the bogie 20. Thus, the web roll 19 rolls over by its own weight to the turntable 24 locating adjacent thereto. This apparatus, however, involves a danger that the web roll 19 overruns the turntable 24 and drops to the opposite side, since the transference of the web roll 19 to the turntable 24 is achieved instantaneously to gather rolling power. The bogie lifting apparatus suffers a problem that it is absolutely useless when a web roll 19 loaded on the turntable 24 is to be unloaded in the direction indicated by the outlined arrow shown in FIG. 12.

This invention is proposed in view of the above disadvantages inherent in the combination of the turntable and bogies employed in the web roll transferring station and solve them successfully, and it is an object of this invention to provide a roll transferring apparatus which enables automatic unloading (toward upstream) or transference of a web roll loaded on the turntable easily to any of the bogies locating on each side of the turntable, or automatic transference of the web roll loaded on a bogie to the turntable with no fear of overrunning, and which can stop rolling of the web roll immediately after transference.

SUMMARY OF THE INVENTION

In order to overcome the above problems and attain the intended object successfully, this invention provides a web roll transferring apparatus consisting of a roll stand, a couple of bogies which run on the rails disposed on each side of the roll stand and a turntable disposed in a roll transferring station locating in front of the roll stand so as to be rotatable horizontally; transference of a web roll being designed to be carried out between the turntable (24) and the bogies stopping at the predetermined positions provided on each side of the turntable; characterized in that at least one jack disposed beneath the turntable, which can be operated to tilt the turntable to one of the bogies or to the side opposite to the roll stand to a predetermined angle.

DESCRIPTION OF PREFERRED EMBODIMENTS

Next, the web roll transferring apparatus according to this invention will now be described more specifically by way of preferred embodiments referring to the attached drawings.

Figure 1:
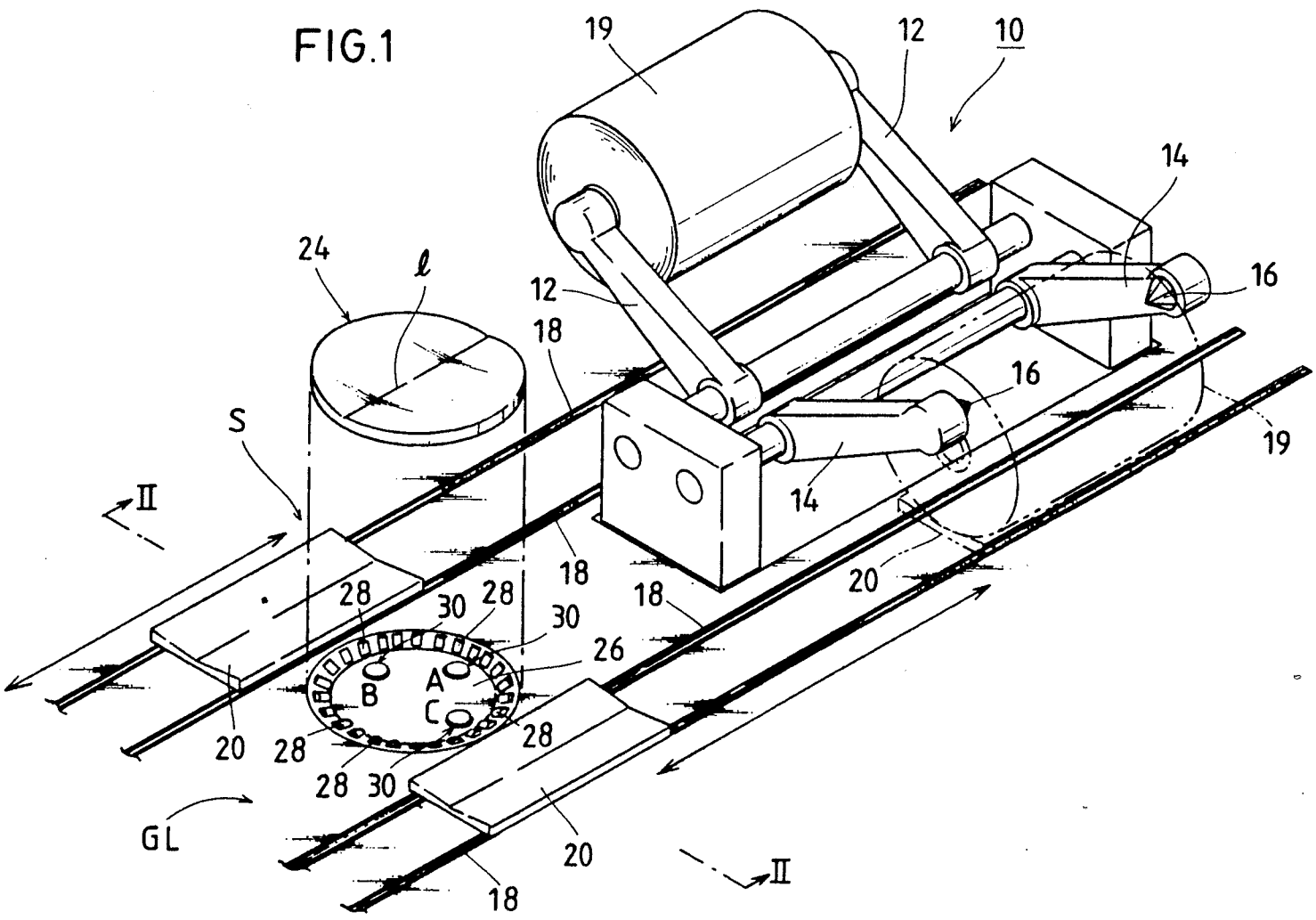
FIG. 1 shows schematically in perspective view the entire constitution of a roll transferring apparatus according to one embodiment of this invention, in which the turntable is shifted upward so as to make the invisible section of the apparatus visible.
Figure 12:
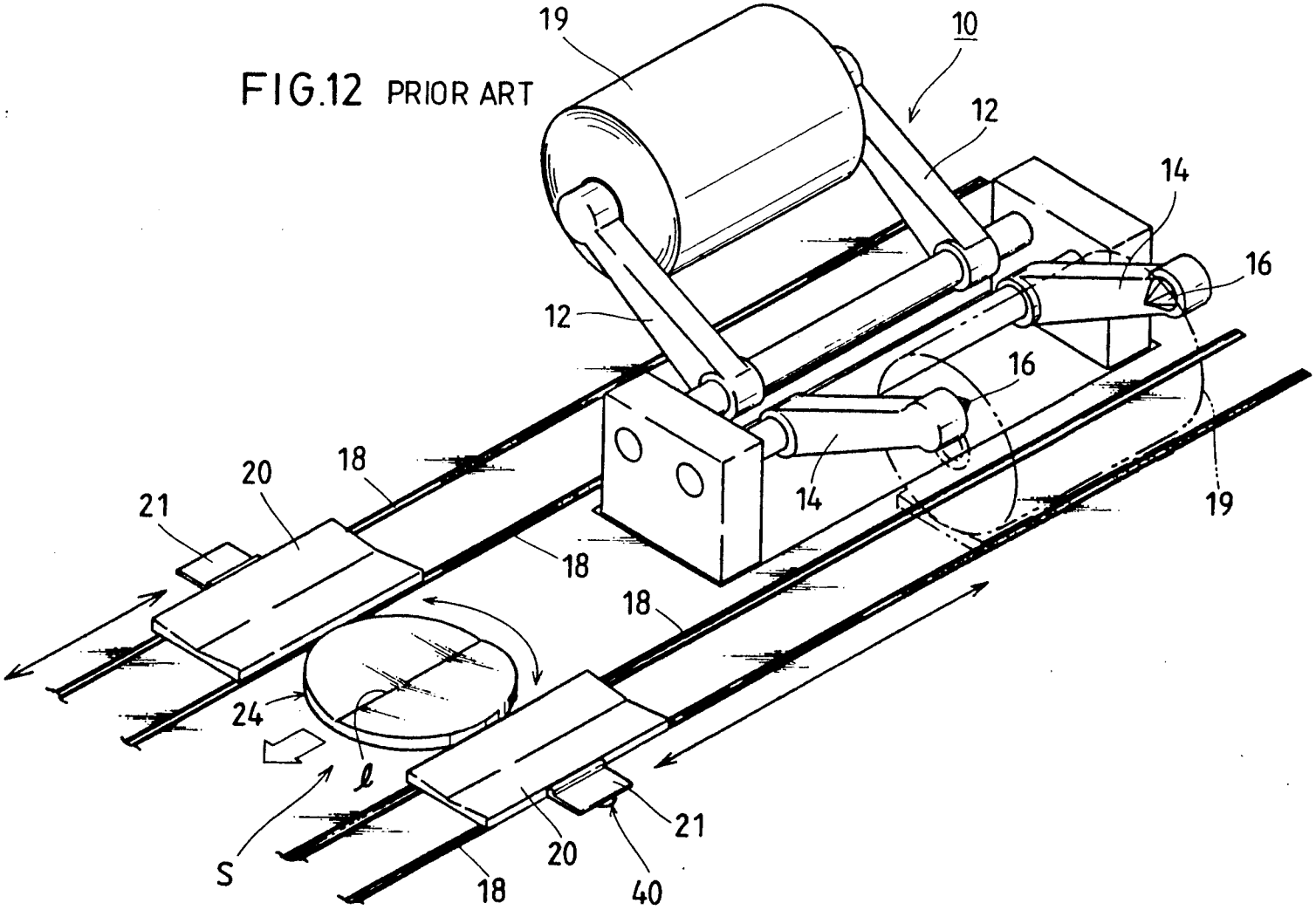
FIG.12 PRIOR ART
FIG. 12 shows schematically in perspective view a prior art roll transferring apparatus.

The constitution and arrangement of the roll stand 10, bogies 20 and turntable 24 shown in FIG. 1 are basically the same as those already explained referring to FIG. 12. However, the difference in this invention is that at least one jack 30 is incorporated beneath the turntable 24, and that the turntable 24 is designed to be tilted in a predetermined direction to a predetermined a predetermined angle by operating the jack 30. While at least one jack 30 can be disposed, it is preferred to dispose three jacks 30. For example, in the embodiment shown in FIG. 4, draw an imaginary right-angled isosceles triangle on the ground of the factory site GL on which the turntable is installed, and the three hydraulic jacks 30 are embedded in the ground at the positions assuming the apeces A, B and C of the triangle.

Figure 2:
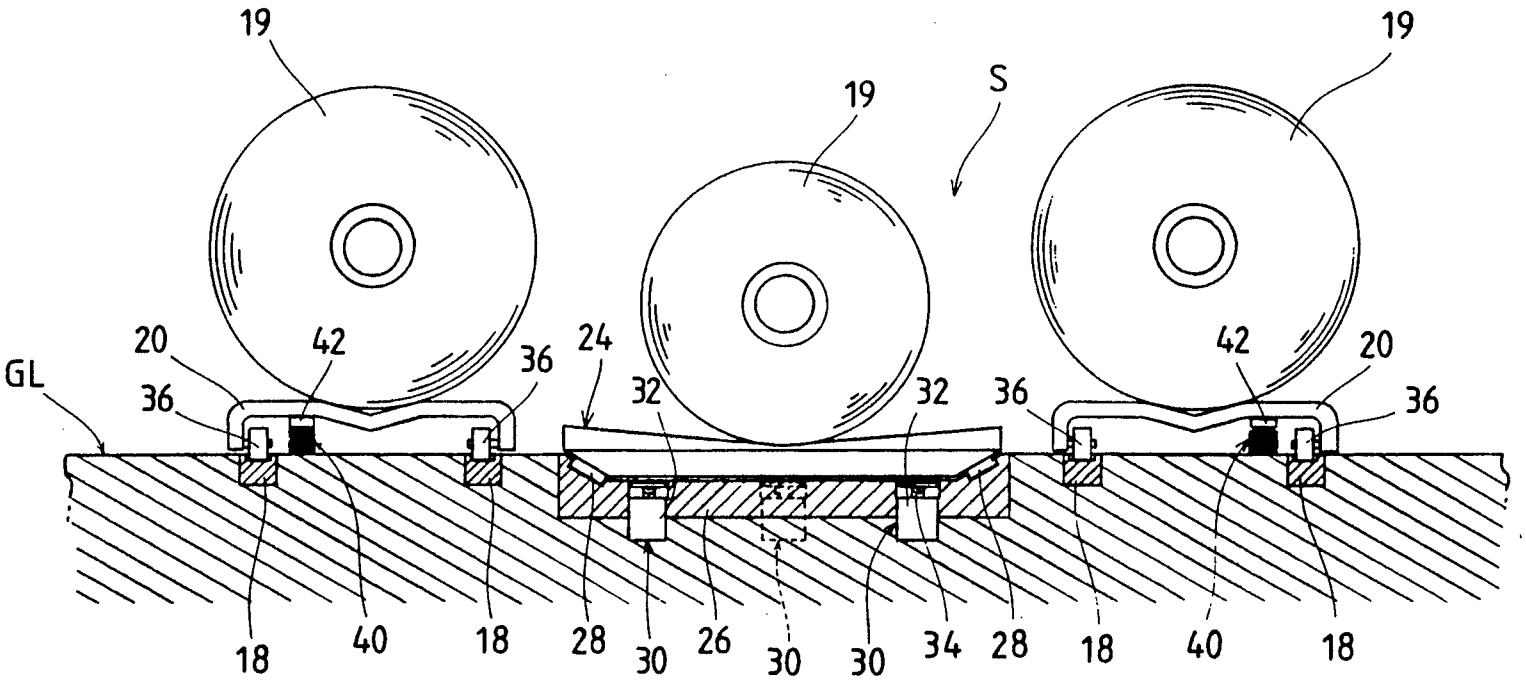
FIG. 2 shows the apparatus shown in FIG. 1 in vertical cross section along the line orthogonal to the rails drawn across the roll transferring station.

To describe more specifically, as shown in FIGS. 1 and 2, a predetermined depth of pit is defined in the factory site GL at the roll transferring station S, and in this pit is disposed a circular base 26 for rotatably supporting the turntable 24. The circular base 26 is made of a ring member in which an annular slope is defined so as to be able to accommodate the lower surface of the turntable 24 therein. A plurality of roller bearings 28 are rotatably disposed on the annular slope at predetermined intervals, on which the turntable 24 can be placed rotatably on the horizontal plane. Incidentally, rotation of the turntable 24 is indexed at an interval of 90° automatically so that it can stop at the position where the center line l thereof is parallel to the rails 18 (see FIG. 4) and the position where the line l thereof is orthogonal to the rails 18 (see FIG. 6), while the horizontal rotation of the table is achieved manually or mechanically, for example, by a motor (not shown).

Figure 4:
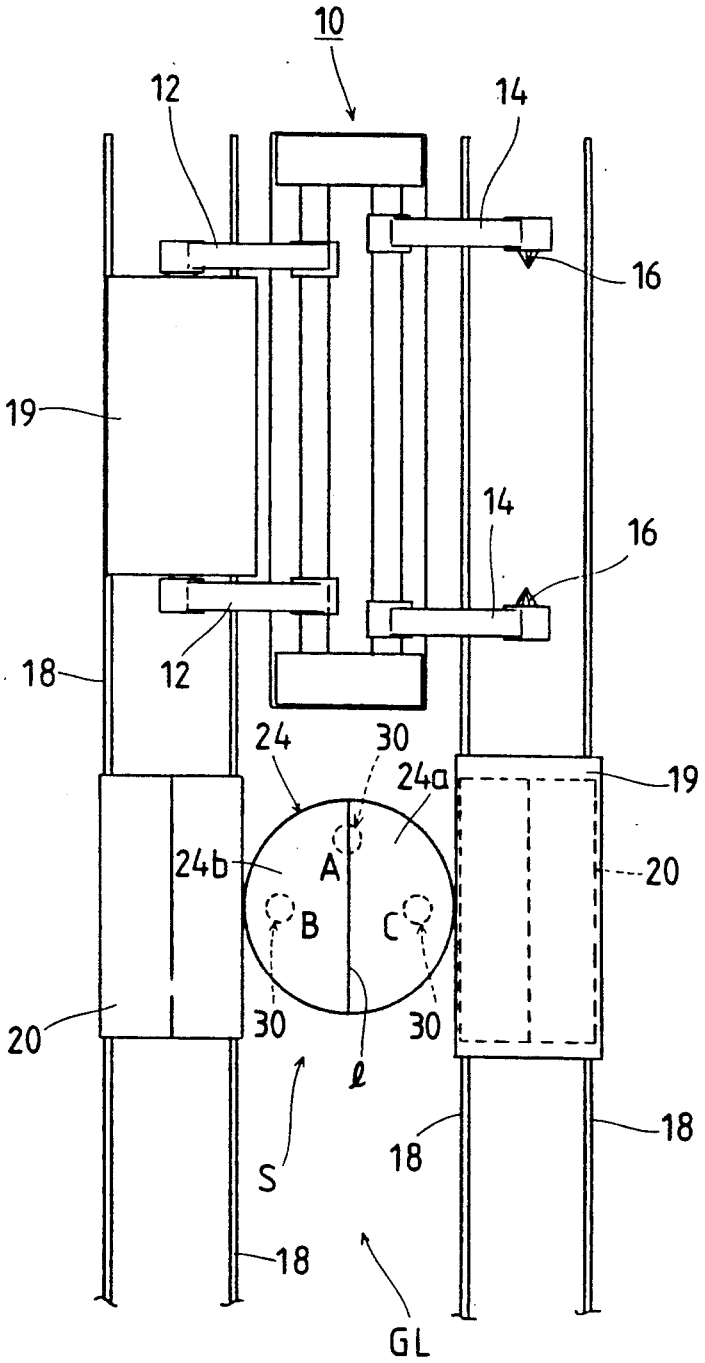
FIG. 4 shows a plan view of the roll transferring station shown in FIG. 1, illustrating a situation where a web roll loaded on the bogie locating on the right side is being transferred toward the turntable.
Figure 6:
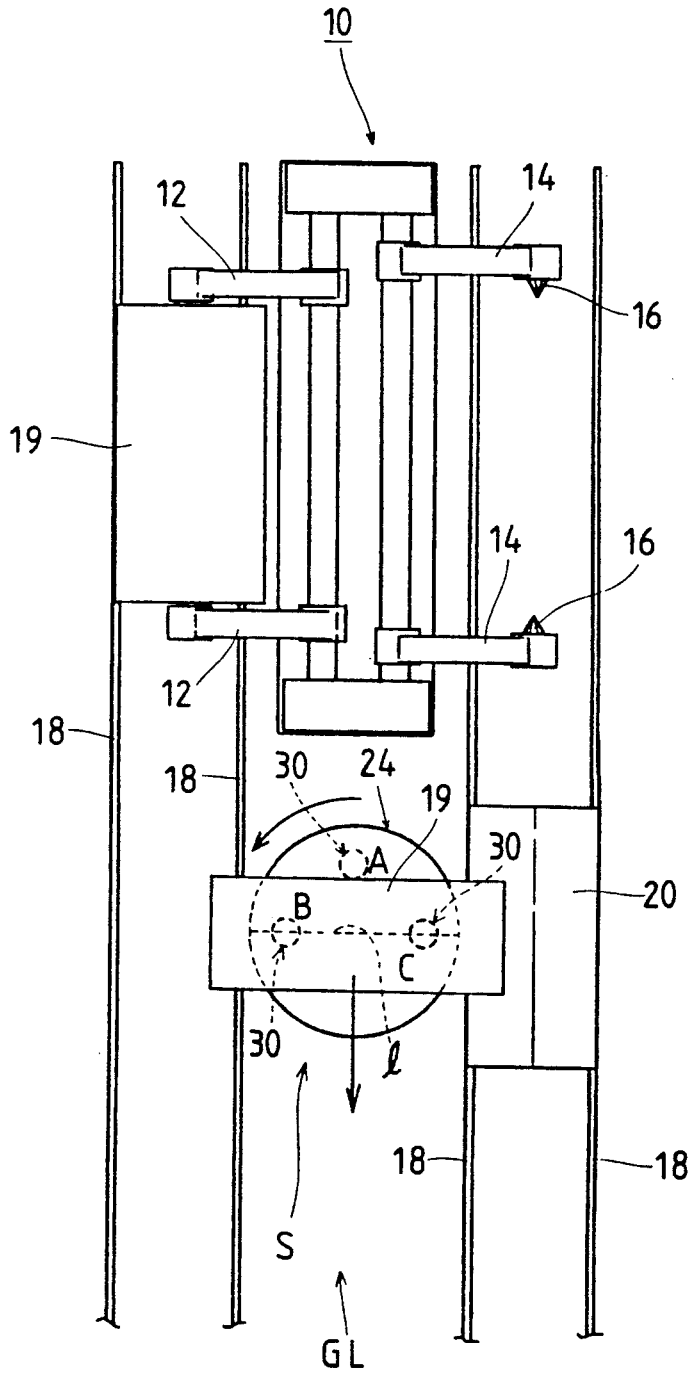
FIG. 6 shows in plan view the situation where a web roll loaded on the turntable is being unloaded in the direction indicated by the arrow.

The three apeces A, B and C of the triangle at which the hydraulic jacks 30 are embedded are in the following relationship: When the center line l of the turntable 24 is orthogonal to the rails 18 as shown in FIG. 6, the apeces B and C are found at the positions immediately beneath the center line l of the turntable 24 and adjacent to the rails 18, respectively. Meanwhile, when the center line l is parallel to the rails 18 as shown in FIG. 4, the apex A is found at a position immediately beneath the center line l and adjacent to the roll stand 10. The jacks 30 each consist of an inverted vertical cylinder 32 and a piston 34 disposed retractably therein, and these jacks 30 can selectively be operated.

Figure 5:
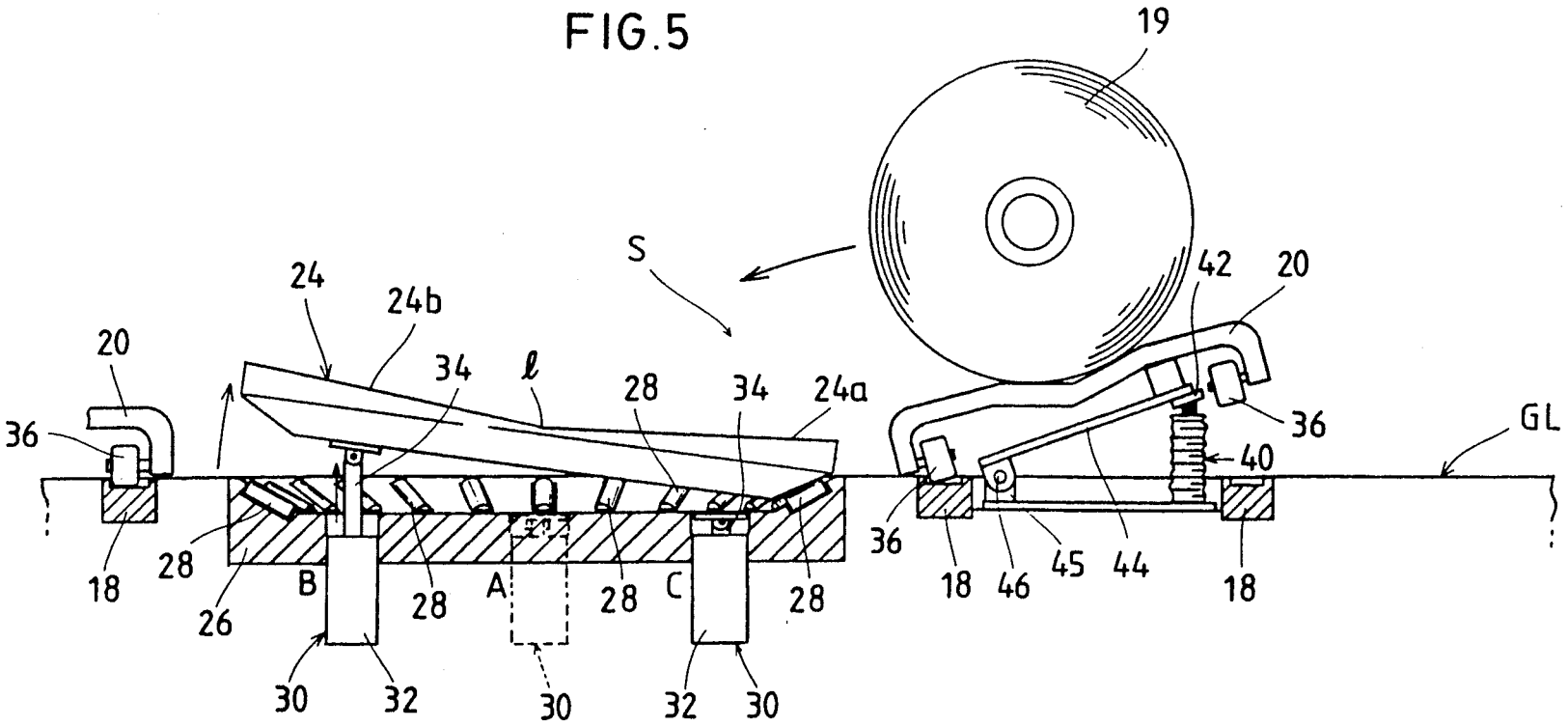
FIG. 5 is a vertical cross section for illustrating the action in FIG. 4.
Figure 7:
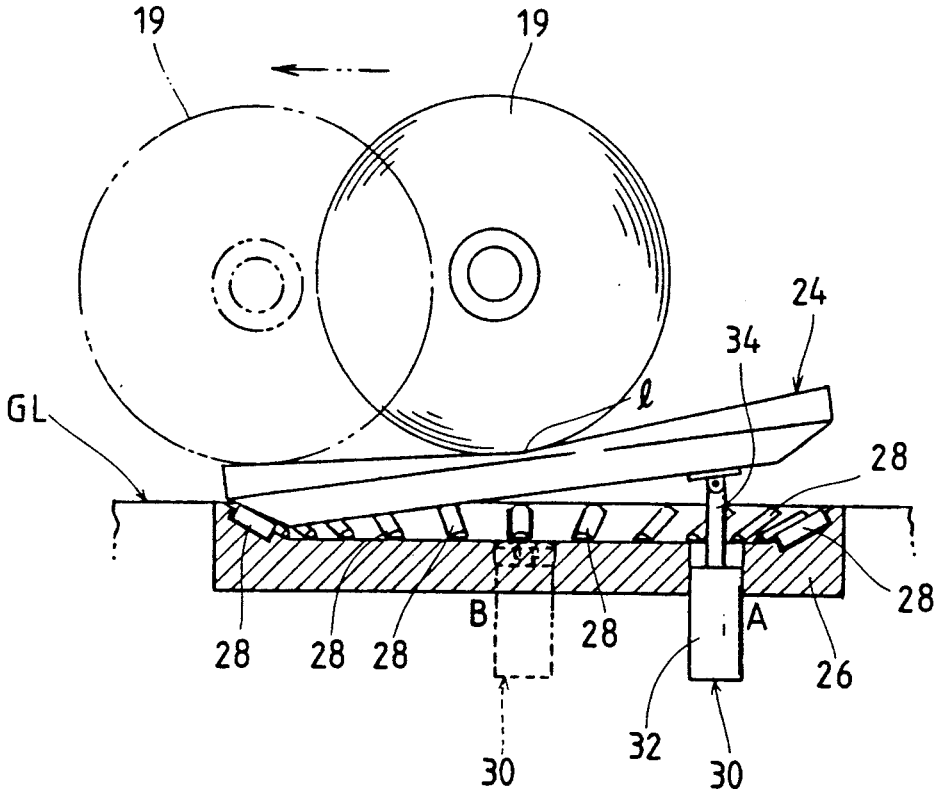
FIG. 7 shows in vertical cross section a situation where the turntable is tilted so as to execute the action shown in FIG. 6.
Figure 8:
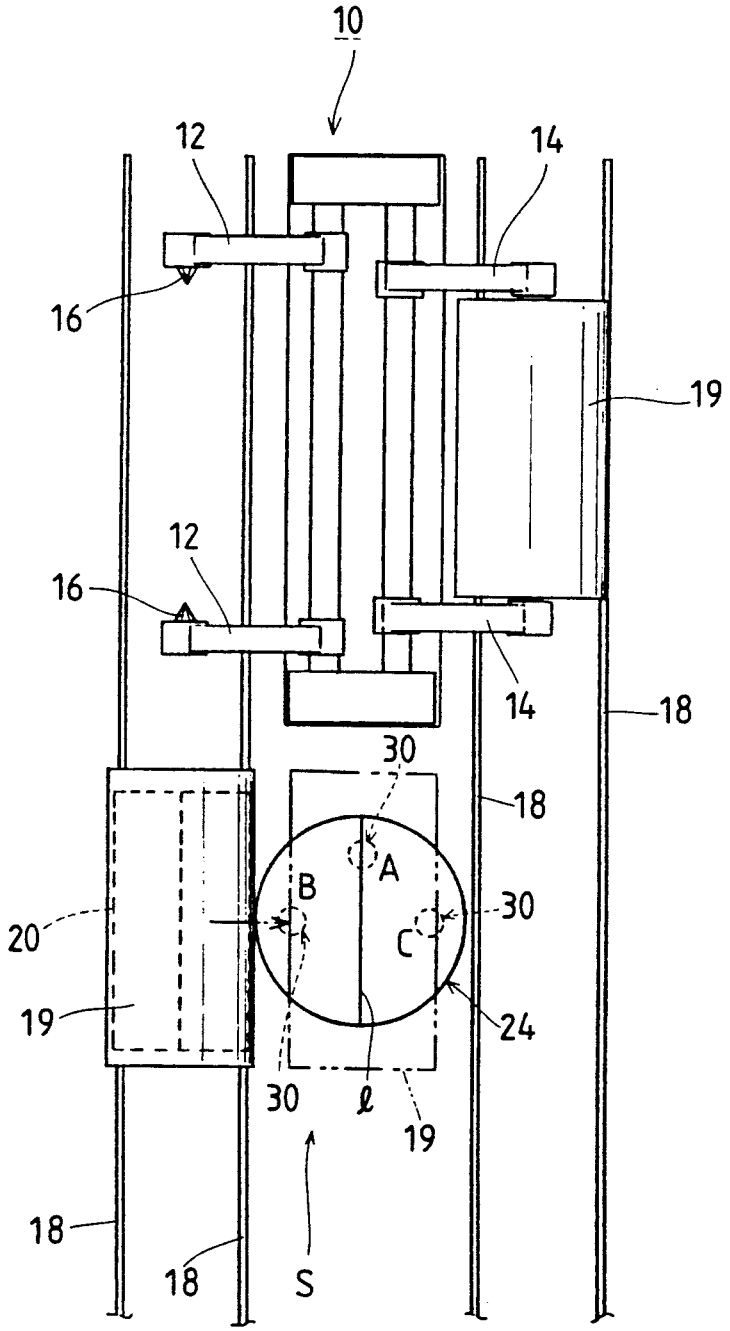
FIG. 8 shows in plan view a situation where a web roll loaded on the bogie locating on the left side is being transferred toward the turntable.
Figure 9:
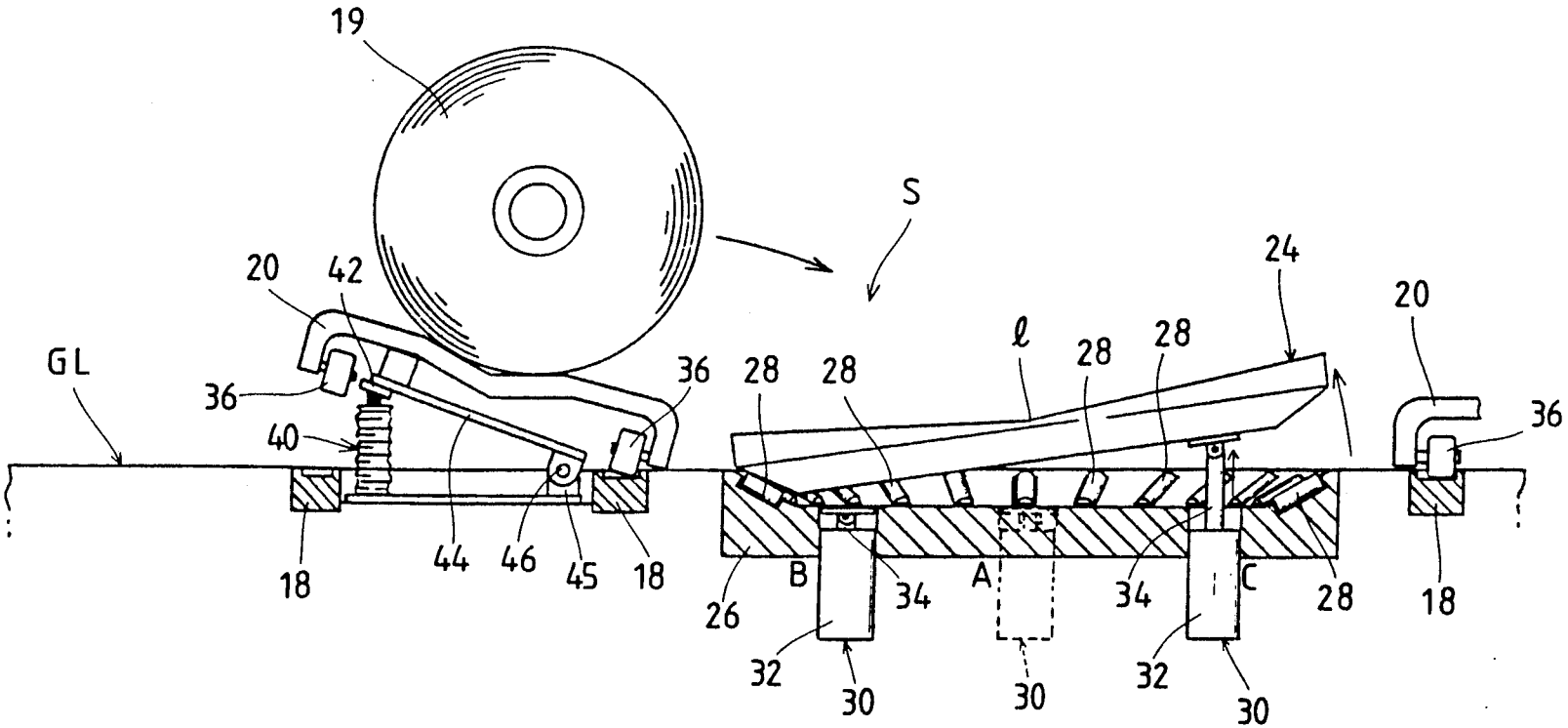
FIG. 9 shows a vertical cross section for illustrating the action shown in FIG. 8.

When the turntable 24 is pushed upward at a peripheral portion, it can be tilted in the direction to which it is urged, since it is merely placed on the group of roller bearings 28. Accordingly, if the jack 30 disposed at the position A, for example, is operated, the turntable 24 is tilted toward upstream (in the direction opposite to the roll stand 10) as shown in FIG. 7; or if the jack 30 disposed at the position B is operated, the turntable 24 is tilted toward the bogie 20 locating on the right side as shown in FIG. 5. If the jack 30 disposed at the position C is operated, the turntable 24 is tilted toward the bogie 20 locating on the left side as shown in FIGS. 8 and 9. While three jacks 30 are disposed in the illustrated embodiment, it is also possible to dispose only one jack 30, for example, at the position A. While a fluid pressure such as hydraulic pressure or pneumatic pressure is preferably used as the source for driving the jacks 30, the driving source may otherwise be of a system using a combination of an electric motor and a screw or of a rack-and-pinion system.

Figure 3:
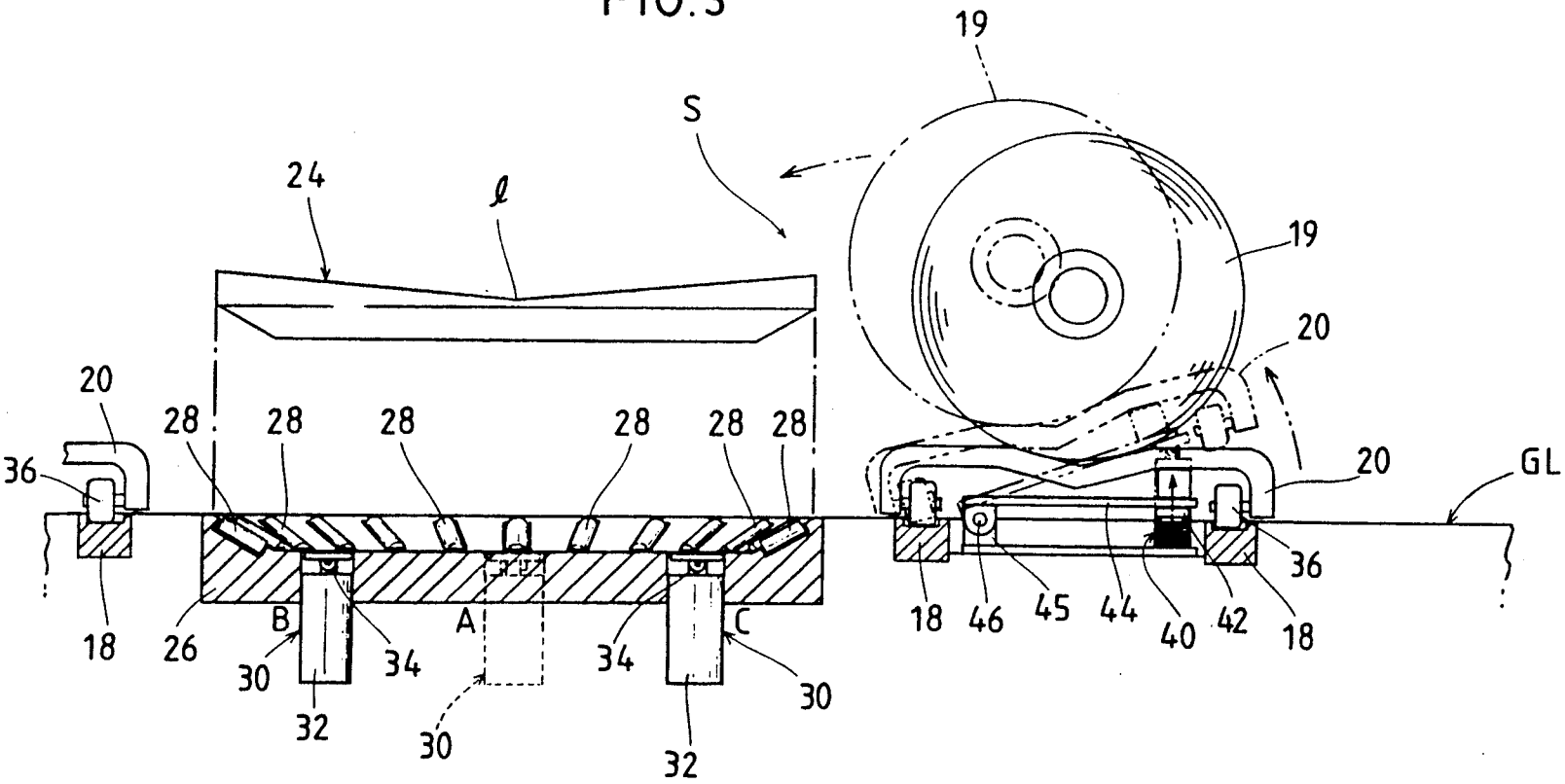
FIG. 3 is a partially enlarged view of the cross section shown in FIG. 2, i.e. the cross section of the turntable and the bogie locating on the right side, in which the turntable is shifted upward so as to provide good view of a supporting base.
Figure 13:
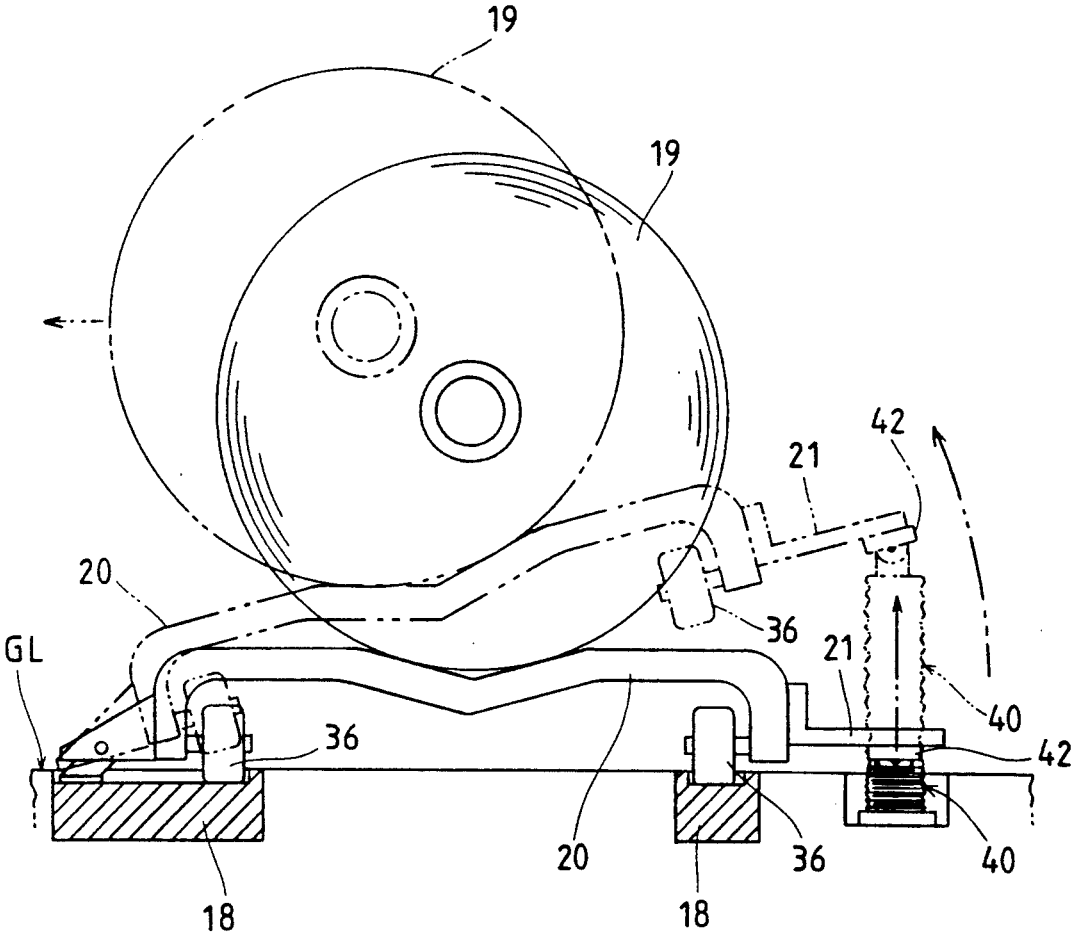
FIG.13 PRIOR ART
FIG. 13 shows in vertical cross section a prior art mechanism for tilting the bogie.

The bogies 20 to be employed in this embodiment are designed to be tilted to a predetermined angle toward the turntable 24, as shown in FIG. 3. As the mechanism for tilting the bogies 20, an improvement of the mechanism shown in FIG. 13 can preferably be used. More specifically, at the positions, between each pair of rails 18, on each side of the turntable 24 where the bogies 20 are to stop, intermediate members 44 having a size smaller than that of the bogies 20 are pivotally supported on supports 45 through pins 46, respectively, so that they can be pivoted diagonally upward. For example, when a hydraulic jack 40 disposed on the opposite side of the support 45 is operated, the bogie 20 is pushed up diagonally through the intermediate member 44 and tilted counterclockwise on the left wheels to a predetermined angle. A patch 42 disposed on the top of the jack 40 is slidably abutted against the intermediate member 44, so that the patch 42 pushes up the bogie 20 while it slides on the intermediate member 44, when the jack 40 is operated.

Figure 10:
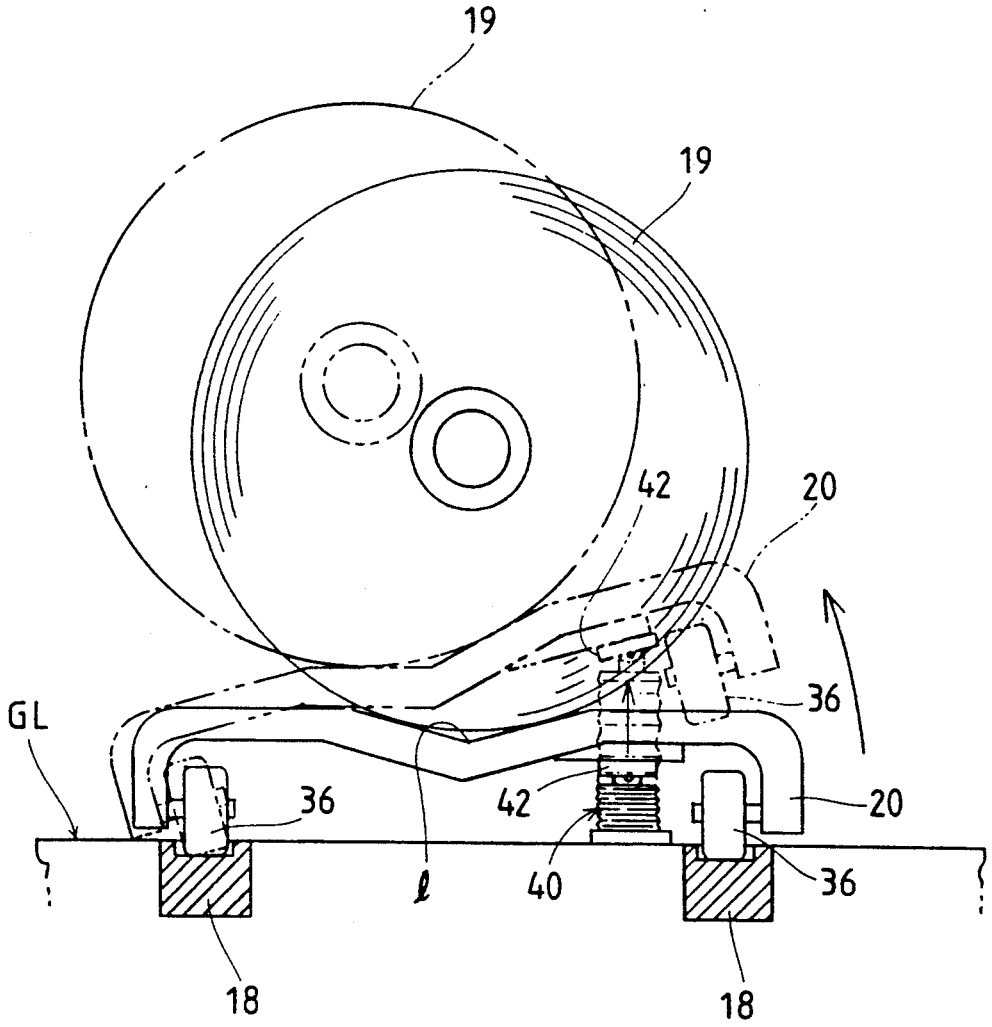
FIG. 10 shows in vertical cross section another embodiment of the mechanism for tilting the bogie.

FIG. 10 shows another embodiment of the tilting mechanism. In this embodiment, a jack 40 is disposed between the rails 18 so as to allow the patch 42 to be slidably in direct contact with the lower surface of the bogie 20 using no intermediate member. Both of these improved tilting mechanisms, unlike the prior art mechanism shown in FIG. 13, serves to reduce the space for installing jacks.

Figure 11:
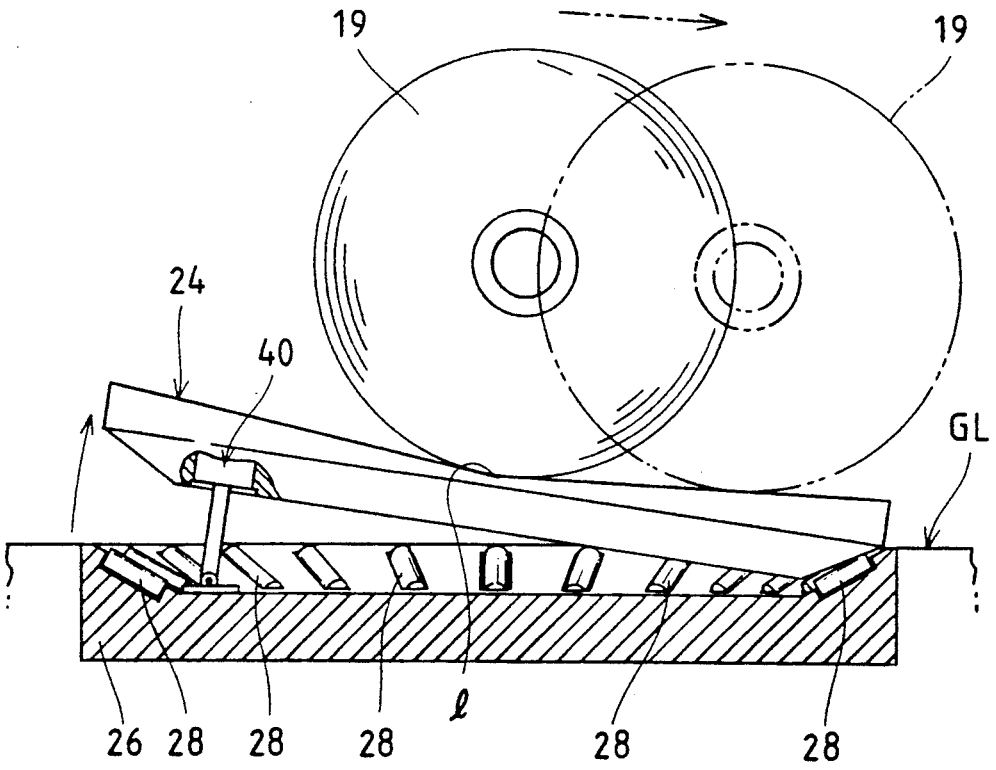
FIG. 11 shows schematically in vertical cross section another embodiment of the mechanism for tilting the turntable according to this invention.

FIG. 11 shows another embodiment of this invention, in which a single jack 40 is attached invertedly to the lower surface of the turntable 24. In this embodiment, it is necessary that the jack 40 can be connected to the jack driving source such as a hydraulic system irrespective of the rotation of the turntable 24, and the single jack 40 can be turned horizontally together with the turntable 24 to a required angle to stop at the indexed position A, B or C so as to tilt the turntable 24 in the required direction. According to this embodiment, the number of jacks can be reduced, advantageously.

Next, actions when the web roll transferring apparatus according to this embodiment is operated will be described. First, a situation where the web roll 19 having been mounted on the second arms 14 of the roll stand 10 is transferred to the bogie 20 waiting on the right side of the roll stand 10 will be described. The bogie 20 with the web roll 19 loaded thereon runs on the rails 18 and stops at the predetermined position on the right side of the roll transferring station S; wherein the turntable 24 is indexed so that the center line l thereof may be parallel with the rails 18, as shown in FIG. 4. In this state the jack 40 disposed below the bogie 20 is operated, as shown in FIG. 5, to push up the right side of the bogie 20 via the intermediate member 44 and tilt the bogie 20 counterclockwise on the left side wheels 36 to a predetermined angle. Thus, the web roll 19 loaded on the bogie 20 rolls over by its own weight in the direction indicated by the arrow onto the turntable 24.

When the jack 30 disposed at the position B of the turntable 24 is operated in synchronization with the timing of tilting the bogie 20, the piston 34 protrudes upward from the cylinder 32 to tilt the turntable 24 clockwise, as shown in FIG. 5. This tilting of the turntable 24 is designed to be in such a relationship that (1) the sloped face 24*a* of the turntable 24 closer to the rails may form a gentle angle with the horizon sloping down to the rail and (2) the other sloped face 24*b* can prevent the web roll 19 rolling over from the bogie 20 from overrunning the turntable 24. Thus, the web roll 19 rolled over from the bogie 20 can be caught on the sloped surface 24*a* of the turntable 24 tilted toward the rails 18 for receiving the web roll 19. While the web roll 19 is gathering a power by the inertia of rolling, the web roll 19 is effectively prevented from overrunning the turntable 24 and drops to the opposite side by virtue of the greater gradient formed by the opposite sloped face 24*b* of the turntable 24. If the jack 30 is operated otherwise to retract the piston 34 into the cylinder 32 in synchronization with the timing of transferring the web roll 19 to the turntable 24, the turntable 24 returns to the original position and assume a horizontal posture. Accordingly, the rolling of the web roll 19 to and fro several times on the upper surface of the turntable 24 as observed in the prior art turntable can be damped quickly. In the case of the transference of the web roll 19 loaded on the turntable 24 to the bogie 20 stopping adjacent thereto, the above actions explained referring to FIG. 5 can be repeated likewise in a reversed manner.

After completion of the operation of transferring the web roll 19 from the bogie 20 to the turntable 24, as described above, the web roll 19 loaded on the turntable 24 must be unloaded from the turntable 24 toward upstream (in the direction opposite to the roll stand 10). In order to unload the web roll 19 from the turntable 24, the turntable 24 is indexed in such a way that it may be turned horizontally counterclockwise by 90°, as shown in FIG. 6, to make the center line l thereof be orthogonal with the rails 18. Then, the jack 30 disposed at the position A beneath the turntable 24 is operated to tilt the turntable 24 toward upstream, as shown in FIG. 7, and thus the web roll 19 rolls down from the turntable 24 by its own weight. Meanwhile, when the web roll 19 loaded on the bogie 20 locating on the left side is transferred to the turntable 24, the bogie 20 is tilted clockwise, as shown in FIG. 9, and the jack 30 disposed at the position B beneath the turntable 24 is also operated to tilt the turntable 24 to such an angle as to receive the web roll 19, whereby the web roll 19 is smoothly transferred to the turntable 24 in the same manner as described referring to FIG. 5. When the web roll 19 loaded on the turntable 24 is to be unloaded toward upstream, the turntable 24 is turned horizontally by 90° as described above to stop at the indexed position and make the center line l thereof be orthogonal with the rails 18, and then the jack 30 disposed at the position A is operated to tilt the turntable 24 toward upstream and allow the web roll 19 to roll over and drop therefrom in said direction.

As has been described heretofore, according to the web roll transferring apparatus of this invention, the operation of transferring web rolls 19 to and from between the bogies 20 stopping at predetermined positions in the roll transferring station S and the turntable 24 or unloading the web roll 19 loaded on the turntable 24 toward upstream can automatically be carried out very safely and with high efficiency.

What is claimed is:

1. An web roll transferring apparatus comprising:

a roll stand (10) including first arms (12, 12) and second arms (14, 14), said arms being swingable to right and left about axes in a lengthwise direction and chucking web rolls;

rails (18, 18) disposed on right and left sides of said roll stand (10) so as to be parallel to said axes;

a plurality of bogies (20) that run on each one of said rails;

a roll transferring station (S) disposed on an upstream side of said roll station (10) and between said rails (18, 18);

a turn table (24) disposed on said roll transferring station (S) in a horizontally rotatable manner, said turn table (24) stopping its rotation at a position where a center line of said turn table (24) is parallel to said rails (18, 18) and at a position where said center line of said turn table (24) is orthogonal to said rails (18, 18); said apparatus further comprising:

a plurality of jack means (30) provided on said roll transferring station (S) where said turn table (24) is disposed, two of said jack means (30, 30) being directly underneath said center line (l) of said turn table (24) when said center line (l) is orthogonal to said rails and each of said two jack means is close to each of said rails, and one of said jack means (30) is directly underneath said center line (l) when said center line (l) of said turn table (24) is parallel to said rails and said one jack means is close to said roll stand (10), and wherein said three jack means (30, 30, 30) are selectively operated so as to raise said turn table (24) with one of said three jack means (30) so that said turn table (24) is, at a predetermined angle, tiled toward one of said bogies (20) on either one of said rails (18, 18) or tilted in a direction opposite to said roll stand (10).

2. The web roll-transferring apparatus according to claim 1, wherein the jack (30) is operated by a driving source utilizing a fluid pressure such as hydraulic pressure.

3. The web roll transferring apparatus according to claim 1, wherein the jack (30) is operated by a driving source utilizing a fluid pressure such as pneumatic pressure.

* * * * *